US009611728B2

(12) United States Patent
Oehring

(10) Patent No.: US 9,611,728 B2
(45) Date of Patent: Apr. 4, 2017

(54) COLD WEATHER PACKAGE FOR OIL FIELD HYDRAULICS

(71) Applicant: US Well Services LLC, Houston, TX (US)

(72) Inventor: Jared Oehring, Houston, TX (US)

(73) Assignee: U.S. WELL SERVICES LLC, Houston, TX (US)

( * ) Notice: Subject to any disclaimer, the term of this patent is extended or adjusted under 35 U.S.C. 154(b) by 0 days.

(21) Appl. No.: 15/145,440

(22) Filed: May 3, 2016

(65) Prior Publication Data

US 2016/0319649 A1 Nov. 3, 2016

Related U.S. Application Data

(63) Continuation-in-part of application No. 13/679,689, filed on Nov. 16, 2012, now Pat. No. 9,410,410.

(60) Provisional application No. 62/156,307, filed on May 3, 2015.

(51) Int. Cl.
*E21B 43/26* (2006.01)
*E21B 43/267* (2006.01)

(52) U.S. Cl.
CPC ..... *E21B 43/26* (2013.01); *E21B 43/267* (2013.01)

(58) Field of Classification Search
CPC ..... E21B 43/26; E21B 43/162
USPC ..... 166/308.1, 177.5
See application file for complete search history.

(56) References Cited

U.S. PATENT DOCUMENTS 1,671,436 A 5/1928 Melott
2,004,077 A 6/1935 McCartney
2,220,622 A 11/1940 Aitken
2,248,051 A 7/1941 Armstrong
3,061,039 A 10/1962 Peters
3,066,503 A 12/1962 Fleming
3,334,495 A 8/1967 Jensen
3,722,595 A 3/1973 Kiel
3,764,233 A 10/1973 Strickland
3,773,140 A 11/1973 Mahajan
3,837,179 A 9/1974 Barth
3,881,551 A 5/1975 Terry
4,037,431 A 7/1977 Sugimoto
4,151,575 A 4/1979 Hogue
4,226,299 A 10/1980 Hansen
4,456,092 A 6/1984 Kubozuka
4,512,387 A 4/1985 Rodriguez
4,845,981 A 7/1989 Pearson
(Continued)

FOREIGN PATENT DOCUMENTS

JP 2004264589 9/2004

OTHER PUBLICATIONS

UK Power Networks—Transformers to Supply Heat to Tate Modern—from Press Releases May 16, 2013.

*Primary Examiner* — Kenneth L Thompson
(74) *Attorney, Agent, or Firm* — Hogan Lovells US LLP

(57) ABSTRACT

A hydraulic fracturing system includes an electrically powered pump that pressurizes fluid, which is piped into a wellbore to fracture a subterranean formation. System components include a fluid source, an additive source, a hydration unit, a blending unit, a proppant source, and a fracturing pump. The system includes heaters for warming hydraulic fluid and/or lube oil. The hydraulic fluid is used for operating devices on the blending and hydration units. The lube oil lubricates and cools various moving parts on the fracturing pump.

13 Claims, 5 Drawing Sheets

(56) References Cited

U.S. PATENT DOCUMENTS 5,025,861 A 6/1991 Huber et al.
5,130,628 A 7/1992 Owen
5,131,472 A 7/1992 Dees et al.
5,422,550 A * 6/1995 McClanahan ..... H02P 5/50 318/103
5,548,093 A 8/1996 Sato
5,655,361 A 8/1997 Kishi
5,865,247 A * 2/1999 Paterson ..... E21B 33/138 166/252.1
5,879,137 A 3/1999 Yie
5,894,888 A 4/1999 Wiemers
5,907,970 A 6/1999 Havlovick et al.
6,142,878 A 11/2000 Barin
6,164,910 A 12/2000 Mayleben
6,202,702 B1 3/2001 Ohira
6,254,462 B1 7/2001 Kelton
6,271,637 B1 8/2001 Kushion
6,315,523 B1 11/2001 Mills
6,491,098 B1 12/2002 Dallas
6,529,135 B1 3/2003 Bowers et al.
6,776,227 B2 8/2004 Beida
6,802,690 B2 10/2004 Han
6,931,310 B2 8/2005 Shimizu et al.
7,170,262 B2 1/2007 Pettigrew
7,173,399 B2 2/2007 Sihler
7,312,593 B1 12/2007 Streicher et al.
7,336,514 B2 2/2008 Amarillas
7,445,041 B2 11/2008 O'Brien
7,500,642 B2 3/2009 Cunningham
7,525,264 B2 4/2009 Dodge
7,563,076 B2 7/2009 Brunet
7,683,499 B2 3/2010 Saucier
7,755,310 B2 7/2010 West et al.
7,807,048 B2 10/2010 Collette
7,845,413 B2 * 12/2010 Shampine ..... E21B 43/267 166/105
8,037,936 B2 10/2011 Neuroth
8,054,084 B2 11/2011 Schulz et al.
8,083,504 B2 12/2011 Williams
8,096,891 B2 1/2012 Lochtefeld
8,146,665 B2 4/2012 Neal
8,272,439 B2 9/2012 Strickland
8,310,272 B2 11/2012 Quarto
8,354,817 B2 1/2013 Yeh et al.
8,474,521 B2 7/2013 Kajaria
8,534,235 B2 9/2013 Chandler
8,573,303 B2 11/2013 Kerfoot
8,596,056 B2 * 12/2013 Woodmansee ..... E21B 33/13 166/285
8,727,068 B2 5/2014 Bruin
8,760,657 B2 6/2014 Pope
8,774,972 B2 * 7/2014 Rusnak ..... F04D 15/0066 415/122.1
8,789,601 B2 7/2014 Broussard
8,807,960 B2 8/2014 Stephenson
8,838,341 B2 9/2014 Kumano
8,857,506 B2 10/2014 Stone, Jr.
8,899,940 B2 12/2014 Laugemors
8,905,056 B2 12/2014 Kendrick
8,905,138 B2 * 12/2014 Lundstedt ..... E21B 43/24 166/177.5
8,997,904 B2 4/2015 Cryer
9,018,881 B2 4/2015 Mao et al.
9,051,822 B2 6/2015 Ayan
9,067,182 B2 6/2015 Nichols
9,103,193 B2 8/2015 Coli
9,140,110 B2 9/2015 Coli et al.
9,160,168 B2 10/2015 Chapel
9,322,239 B2 4/2016 Angeles Boza et al.
9,366,114 B2 * 6/2016 Coli ..... E21B 43/26
9,410,410 B2 * 8/2016 Broussard ..... E21B 43/26
2007/0187163 A1 8/2007 Cone
2007/0201305 A1 8/2007 Heilman et al.
2008/0112802 A1 5/2008 Orlando
2008/0137266 A1 6/2008 Jensen
2008/0217024 A1 9/2008 Moore
2008/0264649 A1 10/2008 Crawford
2009/0065299 A1 3/2009 Vito
2009/0188181 A1 7/2009 Forbis
2009/0260826 A1 10/2009 Sherwood
2010/0000508 A1 1/2010 Chandler
2010/0132949 A1 6/2010 DeFosse et al.
2010/0303655 A1 12/2010 Scekic
2010/0322802 A1 * 12/2010 Kugelev ..... F04B 53/147 417/437
2011/0005757 A1 1/2011 Hebert
2011/0017468 A1 1/2011 Birch et al.
2011/0085924 A1 4/2011 Shampine
2011/0272158 A1 11/2011 Neal
2012/0018016 A1 1/2012 Gibson
2012/0085541 A1 4/2012 Love et al.
2012/0127635 A1 5/2012 Grindeland
2012/0205301 A1 8/2012 McGuire et al.
2012/0255734 A1 10/2012 Coli et al.
2013/0233542 A1 9/2013 Shampine
2013/0306322 A1 * 11/2013 Sanborn ..... E21B 43/26 166/308.1
2013/0341029 A1 12/2013 Roberts et al.
2014/0000899 A1 1/2014 Nevison
2014/0010671 A1 1/2014 Cryer et al.
2014/0096974 A1 4/2014 Coli
2014/0124162 A1 * 5/2014 Leavitt ..... E21B 43/26 165/45
2014/0251623 A1 9/2014 Lestz et al.
2015/0083426 A1 3/2015 Lesko
2015/0114652 A1 4/2015 Lestz
2015/0159911 A1 6/2015 Holt
2015/0175013 A1 6/2015 Cryer et al.
2015/0176386 A1 6/2015 Castillo et al.
2015/0211524 A1 7/2015 Broussard
2015/0225113 A1 8/2015 Lungu
2015/0252661 A1 9/2015 Glass
2016/0032703 A1 * 2/2016 Broussard ..... E21B 43/267 166/250.01
2016/0105022 A1 4/2016 Oehring
2016/0177678 A1 6/2016 Morris
2016/0208592 A1 7/2016 Oehring
2016/0258267 A1 * 9/2016 Payne ..... E21B 44/00
2016/0273328 A1 9/2016 Oehring
2016/0290114 A1 10/2016 Oehring
2016/0319650 A1 11/2016 Oehring
2016/0326854 A1 11/2016 Broussard
2016/0348479 A1 12/2016 Oehring
2016/0349728 A1 12/2016 Oehring

* cited by examiner

COLD WEATHER PACKAGE FOR OIL FIELD HYDRAULICS

CROSS REFERENCE TO RELATED APPLICATIONS

This application is a continuation of, and claims priority to and the benefit of, U.S. Provisional Application Ser. No. 62/156,307, filed May 3, 2015 and is a continuation-in-part of, and claims priority to and the benefit of co-pending U.S. patent application Ser. No. 13/679,689, filed Nov. 16, 2012, the full disclosures of which are hereby incorporated by reference herein for all purposes.

BACKGROUND OF THE INVENTION

1. Field of Invention

The present disclosure relates to hydraulic fracturing of subterranean formations. In particular, the present disclosure relates to an electrical hydraulic fracturing system having heaters for heating hydraulic fluid.

2. Description of Prior Art

Hydraulic fracturing is a technique used to stimulate production from some hydrocarbon producing wells. The technique usually involves injecting fluid into a wellbore at a pressure sufficient to generate fissures in the formation surrounding the wellbore. Typically the pressurized fluid is injected into a portion of the wellbore that is pressure isolated from the remaining length of the wellbore so that fracturing is limited to a designated portion of the formation. The fracturing fluid slurry, whose primary component is usually water, includes proppant (such as sand or ceramic) that migrate into the fractures with the fracturing fluid slurry and remain to prop open the fractures after pressure is no longer applied to the wellbore. A primary fluid for the slurry other than water, such as nitrogen, carbon dioxide, foam, diesel, or other fluids is sometimes used as the primary component instead of water. Typically hydraulic fracturing fleets include a data van unit, blender unit, hydration unit, chemical additive unit, hydraulic fracturing pump unit, sand equipment, wireline, and other equipment.

Traditionally, the fracturing fluid slurry has been pressurized on surface by high pressure pumps powered by diesel engines. To produce the pressures required for hydraulic fracturing, the pumps and associated engines have substantial volume and mass. Heavy duty trailers, skids, or trucks are required for transporting the large and heavy pumps and engines to sites where wellbores are being fractured. Each hydraulic fracturing pump is usually composed of a power end and a fluid end. The hydraulic fracturing pump also generally contains seats, valves, a spring, and keepers internally. These parts allow the hydraulic fracturing pump to draw in low pressure fluid slurry (approximately 100 psi) and discharge the same fluid slurry at high pressures (over 10,000 psi). Recently electrical motors controlled by variable frequency drives have been introduced to replace the diesel engines and transmission, which greatly reduces the noise, emissions, and vibrations generated by the equipment during operation, as well as its size footprint.

On each separate unit, a closed circuit hydraulic fluid system is often used for operating auxiliary portions of each type of equipment. These auxiliary components may include dry or liquid chemical pumps, augers, cooling fans, fluid pumps, valves, actuators, greasers, mechanical lubrication, mechanical cooling, mixing paddles, landing gear, and other needed or desired components. This hydraulic fluid system is typically separate and independent of the main hydraulic fracturing fluid slurry that is being pumped into the wellbore. At times a separate heating system is deployed to heat the actual hydraulic fracturing fluid slurry that enters the wellbore. The hydraulic fluid system can thicken when ambient temperatures drop below the gelling temperature of the hydraulic fluid. Typically waste heat from diesel powered equipment is used for warming hydraulic fluid to above its gelling temperature. For diesel powered equipment, this typically allows the equipment to operate at temperatures down to −20° C. However, because electrically powered fracturing systems generate an insignificant amount of heat, hydraulic fluid in these systems is subject to gelling when exposed to low enough temperatures. These temperatures for an electric powered fracturing system typically begin to gel at much higher temperatures of approximate 5° C.

SUMMARY OF THE INVENTION

Disclosed herein is an example of a hydraulic fracturing system for fracturing a subterranean formation, and which includes at least one hydraulic fracturing pump fluidly connected to the well and powered by at least one electric motor, and configured to pump fluid slurry into the wellbore at high pressure so that the fluid slurry passes from the wellbore into the formation, and fractures the formation. The system also includes a variable frequency drive connected to the electric motor to control the speed of the motor, wherein the variable frequency drive frequently performs electric motor diagnostics to prevent damage to the at least one electric motor, and a working fluid system having a working fluid, and a heater that is in thermal contact with the working fluid. Other electric motors on the equipment that do not require variable or adjustable speed (which generally operate in an on or off setting, or at a set speed), may be operated with the use of a soft starter. The working fluid can be lube oil, hydraulic fluid, or other fluid. In one embodiment, the heater includes a tank having working fluid and a heating element in the tank in thermal contact with the working fluid. The heating element can be an elongate heating element, or a heating coil, or a thermal blanket that could be wrapped around the working fluid tank. The system can further include a turbine generator, a transformer having a high voltage input in electrical communication with an electrical output of the turbine generator and a low voltage output, wherein the low voltage output is at an electrical potential that is less than that of the high voltage input, and a step down transformer having an input that is in electrical communication with the low voltage output of the transformer. The step down transformer can have an output that is in electrical communication with the heater. In an example, more than one transformer may be used to create multiple voltages needed for the system such as 13,800 V three phase, 600 V three phase, 600 V single phase, 240 V single phase, and others as required. In an example, the pumps are moveable to different locations on mobile platforms.

Also described herein is another example of a hydraulic fracturing system for fracturing a subterranean formation and that includes a pump having a discharge in communication with a wellbore that intersects the formation, an electric motor coupled to and that drives the pump, a variable frequency drive connected to the electric motor that controls a speed of the motor and performs electric motor diagnostics, and a working fluid system made up of a piping circuit having working fluid, and a heater that is in thermal contact with the working fluid. The working fluid can be lube oil or hydraulic fluid, which is circulated using an electric lube pump through the hydraulic fluid closed circuit for each piece of equipment. In one embodiment, on each separate unit, a closed circuit hydraulic fluid system can be used for operating auxiliary portions of each type of equipment. These auxiliary components may include dry or liquid chemical pumps, augers, cooling fans, fluid pumps, valves, actuators, greasers, mechanical lubrication, mechanical cooling, mixing paddles, landing gear, conveyer belt, vacuum, and other needed or desired components. This hydraulic fluid system can be separate and independent of the main hydraulic fracturing fluid slurry that is being pumped into the wellbore. At times a separate heating system is deployed to heat the actual hydraulic fracturing fluid slurry that enters the wellbore. The hydraulic fracturing system can optionally include a turbine generator that generates electricity for use in energizing the motor. In an example, the pump is a first pump and the motor is a first motor, the system further including a trailer, a second pump, and a second motor coupled to the second pump and for driving the second pump, and wherein the first and second pumps and motors are mounted on the trailer. In another embodiment, a single motor with drive shafts on both sides may connect to the first and second pumps, wherein each pump could be uncoupled from the motor as required. The hydraulic fracturing system can further include a first transformer for stepping down a voltage of electricity from an electrical source to a voltage that is useable by the pump's electrical motor, and a second transformer that steps down a voltage of the electricity useable by the pump's electrical motor to a voltage that is usable by the heater.

BRIEF DESCRIPTION OF DRAWINGS

Some of the features and benefits of the present invention having been stated, others will become apparent as the description proceeds when taken in conjunction with the accompanying drawings, in which.

Figure 1:
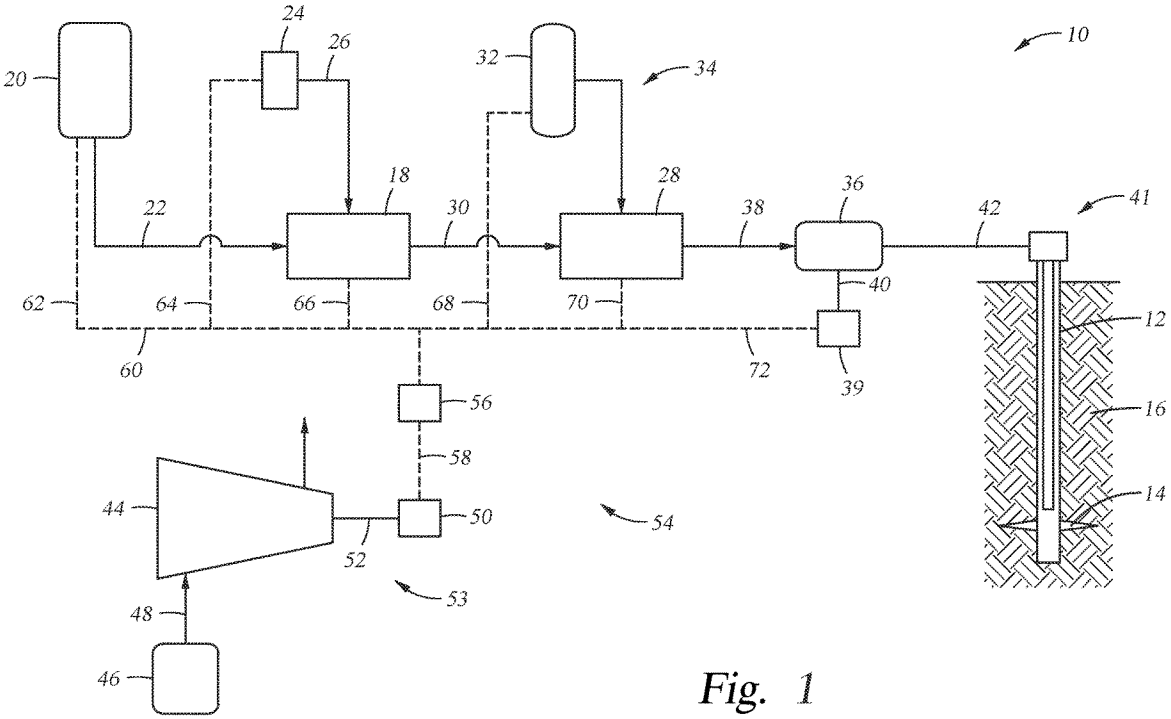
FIG. 1 is a schematic of an example of a hydraulic fracturing system.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is a schematic example of a hydraulic fracturing system 10 that is used for pressurizing a wellbore 12 to create fractures 14 in a subterranean formation 16 that surrounds the wellbore 12. Included with the system 10 is a hydration unit 18 that receives fluid from a fluid source 20 via line 22, and also selectively receives additives from an additive source 24 via line 26. Additive source 24 can be separate from the hydration unit 18 as a stand-alone unit, or can be included as part of the same unit as the hydration unit 18. The fluid, which in one example is water, is mixed inside of the hydration unit 18 with the additives. In an embodiment, the fluid and additives are mixed over a period of time to allow for uniform distribution of the additives within the fluid. In the example of FIG. 1, the fluid and additive mixture is transferred to a blender unit 28 via line 30. A proppant source 32 contains proppant, which is delivered to the blender unit 28 as represented by line 34, where line 34 can be a conveyer. Inside the blender unit 28, the proppant and fluid/additive mixture are combined to form a fracturing slurry, which is then transferred to a fracturing pump system 36 via line 38; thus fluid in line 38 includes the discharge of blender unit 28, which is the suction (or boost) for the fracturing pump system 36. Blender unit 28 can have an onboard chemical additive system, such as with chemical pumps and augers. Optionally, additive source 24 can provide chemicals to blender unit 28; or a separate and stand-alone chemical additive system (not shown) can be provided for delivering chemicals to the blender unit 28. In an example, the pressure of the slurry in line 38 ranges from around 80 psi to around 100 psi. The pressure of the slurry can be increased up to around 15,000 psi by pump system 36. A motor 39, which connects to pump system 36 via connection 40, drives pump system 36 so that it can pressurize the slurry. After being discharged from pump system 36, slurry is injected into a wellhead assembly 41; discharge piping 42 connects discharge of pump system 36 with wellhead assembly 41 and provides a conduit for the slurry between the pump system 36 and the wellhead assembly 41. In an alternative, hoses or other connections can be used to provide a conduit for the slurry between the pump system 36 and the wellhead assembly 41. Optionally, any type of fluid can be pressurized by the fracturing pump system 36 to form injection fracturing fluid that is then pumped into the wellbore 12 for fracturing the formation 14, and is not limited to fluids having chemicals or proppant. Examples exist wherein the system 10 includes multiple pumps 36, and multiple motors 39 for driving the multiple pumps 36. Examples also exist wherein the system 10 includes the ability to pump down equipment, instrumentation, or other retrievable items through the slurry into the wellbore.

An example of a turbine 44 is provided in the example of FIG. 1 and which receives a combustible fuel from a fuel source 46 via a feed line 48. In one example, the combustible fuel is natural gas, and the fuel source 46 can be a container of natural gas or a well (not shown) proximate the turbine 44. Combustion of the fuel in the turbine 44 in turn powers a generator 50 that produces electricity. Shaft 52 connects generator 50 to turbine 44. The combination of the turbine 44, generator 50, and shaft 52 define a turbine generator 53. In another example, gearing can also be used to connect the turbine 44 and generator 50. An example of a micro-grid 54 is further illustrated in FIG. 1, and which distributes electricity generated by the turbine generator 53. Included with the micro-grid 54 is a transformer 56 for stepping down voltage of the electricity generated by the generator 50 to a voltage more compatible for use by electrical powered devices in the hydraulic fracturing system 10. In another example, the power generated by the turbine generator and the power utilized by the electrical powered devices in the hydraulic fracturing system 10 are of the same voltage, such as 4160 V so that main power transformers are not needed. In one embodiment, multiple 3500 kVA dry cast coil transformers are utilized. Electricity generated in generator 50 is conveyed to transformer 56 via line 58. In one example, transformer 56 steps the voltage down from 13.8 kV to around 600 V. Other stepped down voltages can include 4,160 V, 480 V, or other voltages. The output or low voltage side of the transformer 56 connects to a power bus 60, lines 62, 64, 66, 68, 70, and 72 connect to power bus 60 and deliver electricity to electrically powered end users in the system 10. More specifically, line 62 connects fluid source 20 to bus 60, line 64 connects additive source 24 to bus 60, line 66 connects hydration unit 18 to bus 60, line 68 connects proppant source 32 to bus 60, line 70 connects blender unit 28 to bus 60, and line 72 connects motor 39 to bus 60. In an example, additive source 24 contains ten or more chemical pumps for supplementing the existing chemical pumps on the hydration unit 18 and blender unit 28. Chemicals from the additive source 24 can be delivered via lines 26 to either the hydration unit 18 and/or the blender unit 28. In one embodiment, the elements of the system 10 are mobile and can be readily transported to a wellsite adjacent the wellbore 12, such as on trailers or other platforms equipped with wheels or tracks.

Figure 2:
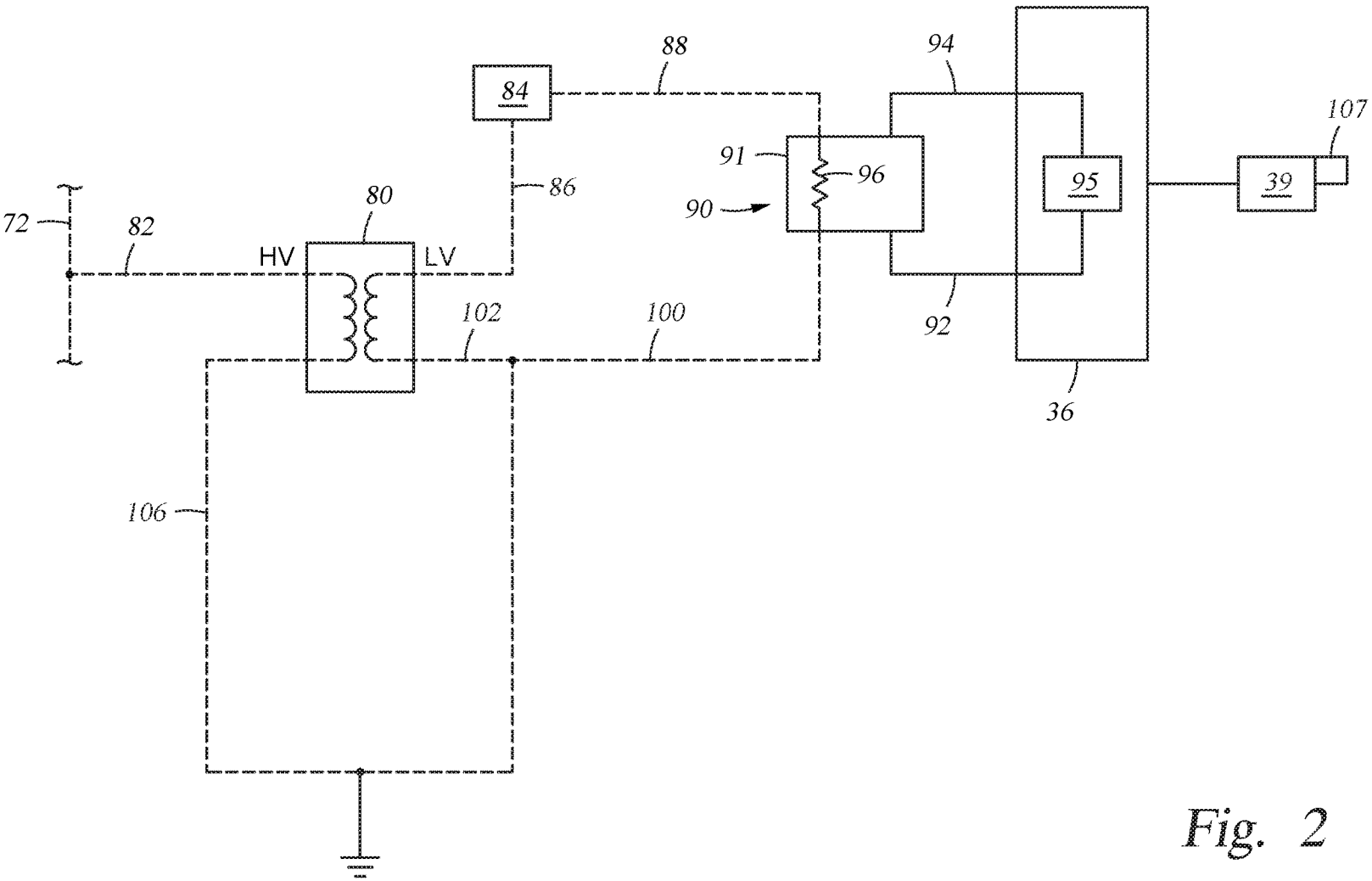
FIGS. 2-4 are schematics of examples of step down transformers and hydraulic fluid heaters for use with the hydraulic fracturing system of FIG. 1.

FIG. 2 shows in a schematic form a portion of the system 10 of FIG. 1 having the electric motor 39. In one embodiment, this is for the hydraulic fracturing pump unit. Included with this example is a step down transformer 80 with a high voltage side HV in communication with line 72 via line 82. Voltage is stepped down or reduced across transformer 80 to a low voltage side LV; which is shown in electrical communication with a load box 84 via line 86. In one example, the high voltage side HV of transformer 80 is at around 600 V, and the stepped down (or low voltage side LV) is at around 240 V. Load box 84, which operates similar to a breaker box, provides tie ins for devices that operate at the stepped down voltage. Line 88 provides communication between motor 39 and a heater system 90, which is illustrated adjacent to motor 39 and is for heating lube oil that is used within pump 36 and other auxiliaries as needed (not shown). Heater system 90 includes a tank 91 in which oil can collect, and flow lines 92, 94 for directing lube oil between the tank 91 and a lube oil system 95 schematically shown with pump 36. An example of a heating element 96 is shown disposed within tank 91 which receives current via line 88 from load box 84. Electrical current flowing through the element 96 is converted into thermal energy, which is transferred to the lube oil and for heating the lube oil in the heater system 90. The heater system 90 may be selectivity energized manually and/or include a thermal switch (not shown) to automatically turn the heating element 96 on and off at desired hydraulic fluid temperatures. Ground lines 100, 102, 106 provide connection between a ground side respectively of the heater system 96, low voltage side of transformer 80, pump 36, and high voltage side of transformer 80 to ground G. Further illustrated in FIG. 2 is an example of a variable frequency drive of ("VFD") 107 and an A/C console (not shown), that control the speed of the electric motor 39, and hence the speed of the pump 36.

Figure 3:
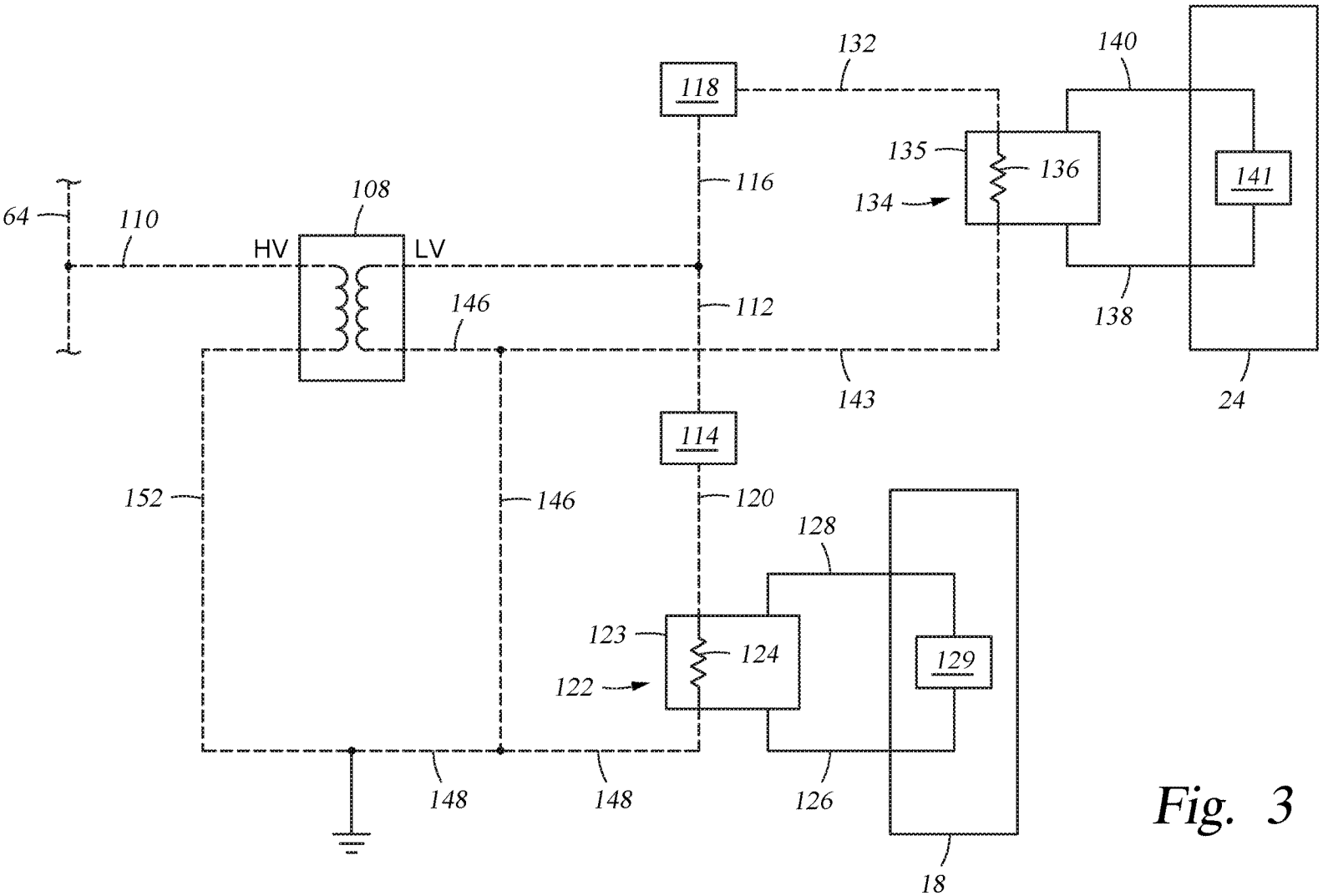

FIG. 3 is a schematic example of a transformer 108 which steps down voltage of electricity within line 64 (which is on the low voltage or stepped down side of transformer 56 of FIG. 1). Line 64 connects to transformer via line 110. Line 112, which connects to a low voltage side LV of transformer 108, conducts electricity at the stepped down voltage to a load box 114, which can provide a source point for use by components (not shown) in or associated with the hydration unit 18 that operate on electricity at the stepped down voltage. Branching from line 112 is line 116 which conducts electricity at the stepped down voltage to a load box 118. Load box 118 defines an energy source point of energy for use by components (not shown) associated with the additive source 24 that operate on electricity at the stepped down voltage. In one example, load boxes 114 and 118 are replaced by a single load box. A hydraulic fluid heating system 122, which is attached to the hydration unit 18, and which includes a tank 123 in which hydraulic fluid used in operating components within hydration unit 18 is heated. An element 124 disposed within tank 123 operates similar to element 96 of FIG. 2. In another embodiment, element 124 is a heating blanket that wrapped around tank 123. Hydraulic fluid is transmitted to and from tank 123 through flow lines 126, 128, which connect to a hydraulically powered device 129 in hydration unit 18. Hydraulically powered device 129 is a schematic representation of any equipment or devices in or associated with hydration unit 18 that are operated by hydraulic fluid. Thus hydraulic fluid heating system 122 warms hydraulic fluid used by hydraulically powered device 129 and prevents thickening of the hydraulic fluid. Line 120 provides electrical communication between element 124 so that it can be selectively energized to warm the hydraulic fluid. The selectivity can be manually operated and/or include a thermal switch to automatically turn the heating element 124 on and off at desired hydraulic fluid temperatures. In one embodiment, a secondary power source (not shown) such as an external generator, grid power, battery bank, or other power source at the same voltage as load box 84 can be connected directly into the as load box 84 to power the heating element without the entire microgrid being energized. This allows heating of the hydraulic fluid prior to starting the entire hydraulic fracturing fleet system.

Electrical connection between load box 118 and additive source 24 is shown provided by line 132. Also included with additive source 24 is a hydraulic fluid heating system 134 which includes a tank 135 for containing hydraulic fluid, and an element 136 within tank 135 for heating hydraulic fluid that is within tank 135. Flow lines 138, 140 provide connectivity between tank 135 and a hydraulically powered device 141 shown disposed in or coupled with additive source 24. Similar to hydraulically powered device 129, hydraulically powered device 141 schematically represents hydraulically operated devices in or coupled with additive source 24. Line 132 provides electrical communication to heating element 136 from load box 118. Similar to hydraulic fluid heating system 122, hydraulic fluid heating system 134 heats hydraulic fluid used by hydraulically powered device 141 so that the hydraulic fluid properties remain at designated operational values. As determined manually and/or include a thermal switch to automatically turn the heating element on and off at desired hydraulic fluid temperatures. Ground lines 143, 146, 148, 152 provide connection to ground G respectively from, hydraulic fluid heating system 34, additive source 24, low voltage side LV of transformer 108, a hydraulic heating fluid system 122, hydration unit 18, and the high voltage HV side of transformer 108. In one embodiment, a secondary power source (not shown) such as an external generator, grid power, battery bank, or other power source at substantially the same voltage as load box 118 and load box 114 can be connected directly into the as load box 118 and load box 114 to power the heating element without the entire microgrid being energized. This allows heating of the hydraulic fluid prior to starting the entire hydraulic fracturing fleet system.

Figure 4:
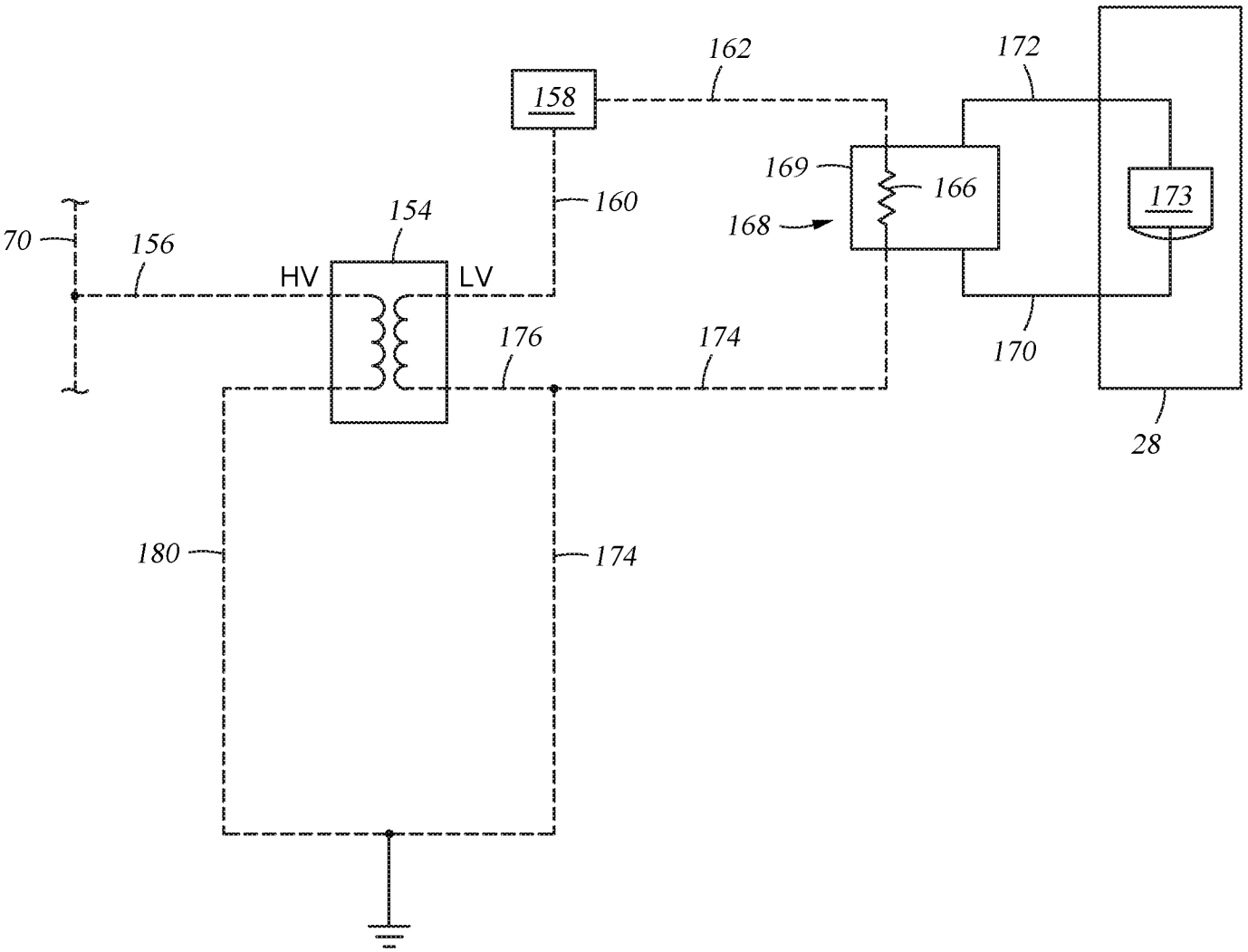

FIG. 4 illustrates a schematic example of a transformer 154 to provide electricity at a stepped down voltage to blender unit 28. In one embodiment, transformer 154 and transformer 108 (FIG. 3) are replaced by a single transformer. In this example, a high voltage side HV of transformer 154 connects to line 70 via line 156. Voltage of electricity received by transformer 154 is stepped down and delivered to a low voltage side LV of transformer 154. A load box 158 is in communication with the low voltage side LV of transformer 154 via line 160. Electricity at load box 158 is communicated through line 162 to blender unit 28. Line 162 selectively energizes an element 166 shown as part of hydraulic fluid heating system 168. Selectivity energizing element 166 can be manually operated and/or include a thermal switch to automatically turn the heating element 166 on and off at desired hydraulic fluid temperatures. System 168 includes a tank 169 in which element 166 is disposed, and which receives hydraulic fluid from blender unit 28 via flow lines 170 and returns hydraulic fluid via flow line 172. Flow lines 170, 172 connect to a hydraulically powered device 173 that is part of the hydration unit. Examples of hydraulically powered units that are powered by hydraulic fluid include chemical pumps, tub paddles (mixers), cooling fans, fluid pumps, valve actuators, and auger motors. Ground lines 174, 176, 180 provide connectivity through ground G from the heating system 168, low voltage side LV of transformer 154, and high voltage side HV of transformer 154. In one embodiment, a secondary power source (not shown) such as an external generator, grid power, battery bank, or other power source at the same voltage as load box 158 can be connected directly into the load box 158 to power the heating element 166 without the entire microgrid being energized. This allows heating of the hydraulic fluid prior to starting the entire hydraulic fracturing fleet system.

Figure 5B:
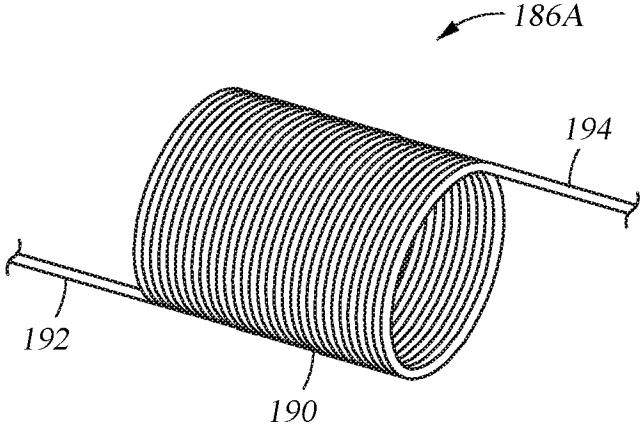
FIG. 5B is a side view of an alternate embodiment of a heating element for use with the tank of FIG. 5A.
Figure 5A:
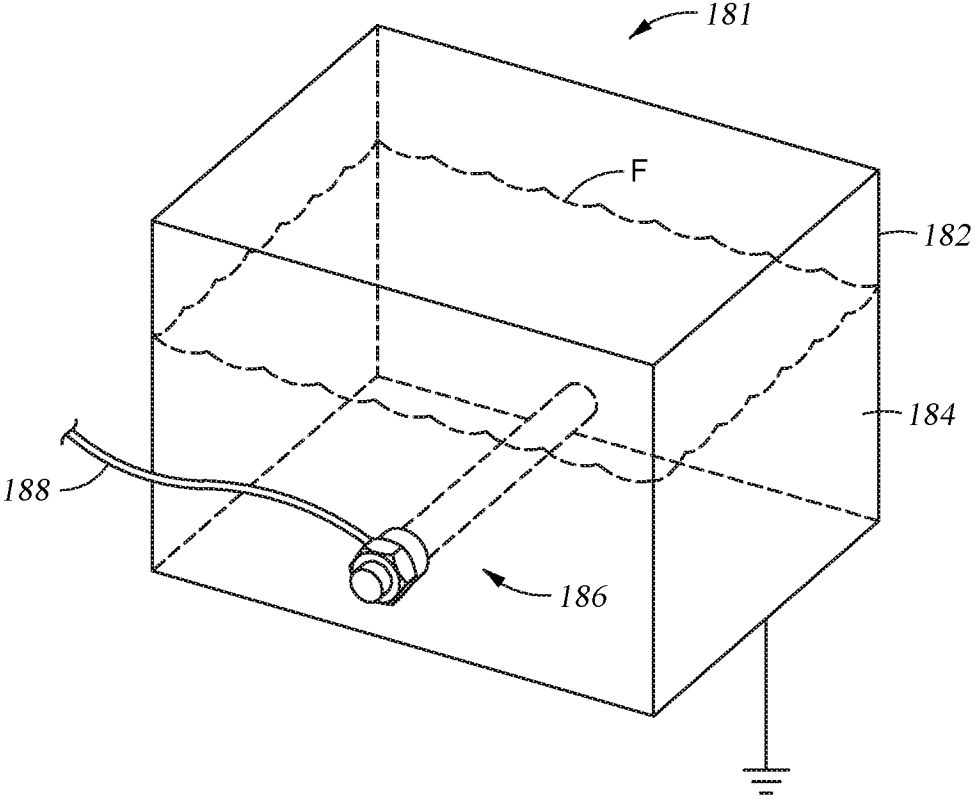
FIG. 5A is a perspective view of an example of a tank with a heating element for warming hydraulic fluid for use with the hydraulic fracturing system of FIG. 1.

FIG. 5A shows in perspective one example of a fluid heating system 181 and which includes a tank 182 having a housing 184 in which fluid F is contained. The fluid F can be hydraulic fluid or lube oil. The heating system 181 of FIG. 5A also includes an elongate heating element 186 shown projecting through a side wall of housing 184. Heat element 186 is strategically disposed so that the portion projecting into tank 182 is submerged in fluid F. Line 188 provides electrical current to the element 186 and which may be from the stepped down voltage of one of the transformers 80 (FIG. 2), 108 (FIG. 3), or 154 (FIG. 4). In this example, the housing 184 can be connected to ground G thereby eliminating the need for a ground line. Fluid heating system 181 of FIG. 5A provides an example embodiment to the heating systems of FIGS. 2-4. FIG. 5B illustrates an alternate example of the element 186A and which is shown made up of a number of coils 190 that are generally coaxially arranged. Opposing ends of the coils 190 have contact leads 192, 194 attached for providing electrical connectivity through which an electrical circuit can be conducted and that in turn causes element 186A to generate thermal energy that can be used in heating the hydraulic fluid or lube oil discussed above.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, heating the fluids as described above can be accomplished by other means, such as heat exchangers that have fluids flowing through tubes. Moreover, electricity for energizing a heater can be from a source other than a turbine generator, but instead can be from a utility, solar, battery, to name but a few. These and other similar modifications will readily suggest themselves to those skilled in the art, and are intended to be encompassed within the spirit of the present invention disclosed herein and the scope of the appended claims.

What is claimed is:

1. A hydraulic fracturing system for fracturing a subterranean formation comprising:

a plurality of electric pumps fluidly connected to the well and powered by at least one electric motor, and configured to pump fluid into the wellbore at high pressure so that the fluid passes from the wellbore into the formation, and fractures the formation;

a variable frequency drive connected to the electric motor to control the speed of the motor, wherein the variable frequency drive frequently performs electric motor diagnostics to prevent damage to the at least one electric motor; and a working fluid system comprising working fluid, and a heater that is in thermal contact with the working fluid;

wherein the heater comprises a tank having working fluid and a heating element in thermal contact with the working fluid.

2. The hydraulic fracturing system of claim 1, wherein the working fluid is selected from the list consisting of lube oil and hydraulic fluid.

3. The hydraulic fracturing system of claim 1, wherein the heating element comprises one of an elongate heating element, a heating coil, or a thermal blanket.

4. The hydraulic fracturing system of claim 1, further comprising a turbine generator, a transformer having a high voltage input in electrical communication with an electrical output of the turbine generator and a low voltage output, wherein the low voltage output is at an electrical potential that is less than that of the high voltage input, and a step down transformer having an input that is in electrical communication with the low voltage output of the transformer.

5. The hydraulic fracturing system of claim 4, wherein the step down transformer has an output that is in electrical communication with the heater.

6. The hydraulic fracturing system of claim 1, wherein the pumps are moveable to different locations on mobile platforms.

7. A hydraulic fracturing system for fracturing a subterranean formation comprising:

a pump having a discharge in communication with a wellbore that intersects the formation;

an electric motor coupled to and that drives the pump;

a variable frequency drive connected to the electric motor that controls a speed of the motor and performs electric motor diagnostics; and a working fluid system comprising a piping circuit having working fluid, and a heater that is in thermal contact with the working fluid;

wherein the working fluid comprises one of lube oil and hydraulic fluid.

8. The hydraulic fracturing system of claim 7, wherein the lube oil circulates through the pump.

9. The hydraulic fracturing system of claim 7, further comprising a hydrator, chemical additive unit, and blender, and wherein the hydraulic fluid circulates through the hydrator, chemical additive unit, and blender.

10. The hydraulic fracturing system of claim 7, further comprising a turbine generator that generates electricity for use in energizing the motor.

11. The hydraulic fracturing system of claim 7, wherein the pump comprises a first pump and the motor comprises a first motor, the system further comprising a trailer, a second pump, and a second motor coupled to the second pump and for driving the second pump, and wherein the first and second pumps and motors are mounted on the trailer.

12. The hydraulic fracturing system of claim 7, further comprising a first transformer for stepping down a voltage of electricity from an electrical source to a voltage that is useable by the pump, and a second transformer that steps down a voltage of the electricity useable by the pump to a voltage that is usable by the heater.

13. The hydraulic fracturing system of claim 7, wherein the pump comprises a first and second pump, and the motor comprises a first motor with two drive shafts.

* * * * *